US005370056A

United States Patent [19]

Huang

[11] Patent Number: 5,370,056

[45] Date of Patent: Dec. 6, 1994

[54] SAFETY EXPLOSION-SOUND TYPE BULLET FOR TOY GUN

[76] Inventor: Shi-Huang Huang, No. 91, Chiou-Tsuoh South Lane, North Area, Taichung City, Taiwan, Prov. of China

[21] Appl. No.: 362

[22] Filed: Jan. 4, 1993

[51] Int. Cl.[5] ..... F42B 4/00; F42B 12/00

[52] U.S. Cl. ..... 102/353; 102/473; 102/502

[58] Field of Search ..... 273/428, 418, 419, 213; 102/473, 498, 501, 502, 513, 529, 281, 353

[56] References Cited

U.S. PATENT DOCUMENTS

| | | | |
|---|---|---|---|
| 65,764 | 6/1867 | Nelson | 102/353 |
| 1,467,755 | 9/1923 | Cimorosi | 102/353 |
| 1,523,761 | 1/1925 | Fabrizio | 102/353 |
| 1,549,485 | 8/1925 | Gehrig | 102/353 |
| 1,845,397 | 2/1932 | Clark et al. | 102/353 |
| 1,914,607 | 6/1933 | Kohn | 102/353 |
| 1,945,217 | 1/1934 | Decker | 102/353 |
| 1,974,015 | 9/1934 | Decker et al. | 102/353 |
| 3,649,020 | 3/1972 | Hall | 273/428 |
| 4,830,370 | 5/1989 | Schlesinger | 273/418 |

*Primary Examiner*—David Brown
*Attorney, Agent, or Firm*—Bacon & Thomas

[57] ABSTRACT

This invention relates to a safety explosion-sound generating type of bullet for a toy gun, and more particularly one having a cavity formed in a plastic body filled with a material which can produce an explosion-sound effect by collision with a hard object and it is covered by a thin layer. When the body is fired and lands against a hard object, the filling material produces a small explosion, like a sound produced by an actual gun. Furthermore, because the small explosion is produced within a very small bullet (for example, a BB), it is impossible to hurt people.

3 Claims, 1 Drawing Sheet

SAFETY EXPLOSION-SOUND TYPE BULLET FOR TOY GUN

BACKGROUND OF THE INVENTION

This invention relates to a safety explosion-sound type bullet for a toy gun, more particularly a bullet (for example, a BB) wherein a cavity is formed in the body, filled with material which can produce a small explosion by violent collision. The body is covered by a thin layer such that, when the body collides with a hard object, it can safely produce a small explosion which sounds like an actual gun.

When users of toy guns participate in a war game, they hope to use it as an actual gun in order to give them a lifelike war game.

It is important to discriminate between a toy gun and an actual gun. However the leisure function of a toy gun is too important to be neglected, so if the actual shape is removed from the toy gun, it must increase the lifelike sense when being fired. The present invention can make conventional BB produce an explosion sound like an actual gun and can also protect the player.

SUMMARY OF THE INVENTION

The primary purpose of this invention is to provide an actual firing effect for a toy gun when it loses its realistic external appearance to maintain the competitive force in market and to be loved by players of a toy gun.

Another purpose of this invention is to offer a small and safe explosion-sound type bullet.

DETAILED DESCRIPTION OF THE PREFERRED EMBODIMENT

Figure 1:
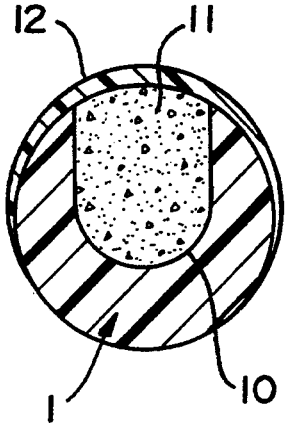
FIG. 1 is a cross-sectional view of this invention.

In referring to the figures according to this invention, a cavity (1) is formed in a small bullet body (for example, a BB), and said cavity is filled with a material (11) which can produce an explosion by violent collision. Said cavity is covered with a thin layer (12) on the body.

Because said body (1) is made of plastic material (for example, ABS), it can prevent being cracked owing to the collision or the explosion, and said filling material (11) can produce an explosion by a violent collision. It is composed of gun powder, paste and sand, and is filled into said cavity (10). When said body collides with a hard object at high speed, a spark from collision between sand particles will ignite said gun powder, and produce a small explosion within said cavity (10). At the same time, it produces an explosion-sound effect like an actual gun. The material of said cladded layer must not produce spattering fragments, for example, pulp, plastic film, Gypsum or paste, to achieve safety in said collision.

Figure 2:
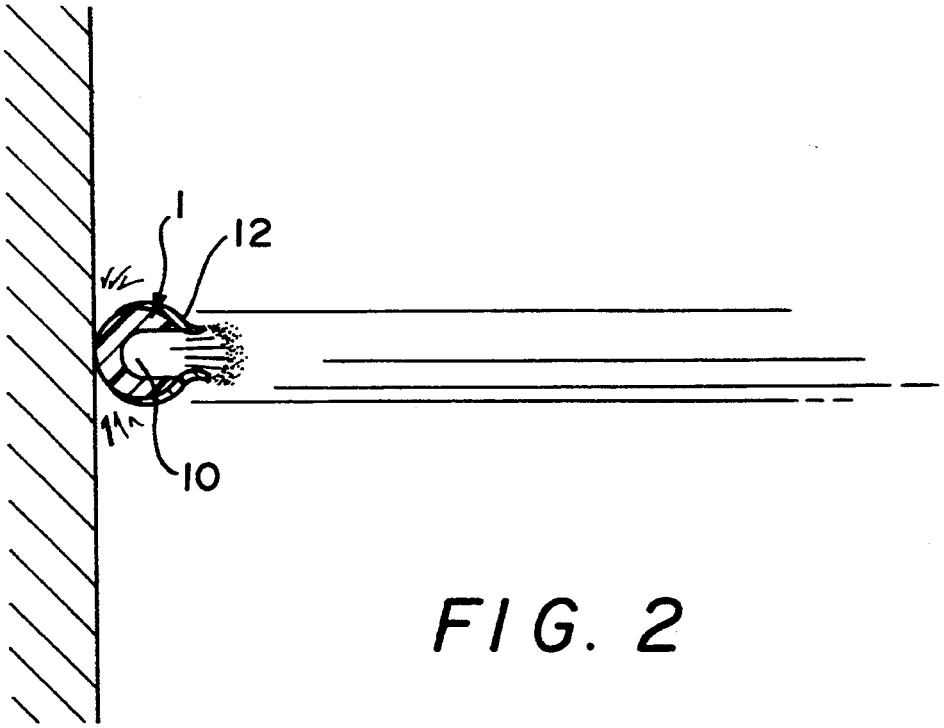
FIG. 2 is a schematic diagram of the explosion caused by a collision of this invention with a hard object.

FIG. 2 is a schematic diagram when said body is fired and collides with a hard object. Said filling material (11) in said cavity (10) will produce an explosion. Because the body is made of hard plastic, the explosion range will be limited to said cavity (10), and because said layer (12) has flexibility, tenacity and powder characteristics, it is impossible to produce fragments large enough to hurt people to maintain safety. Of course, said body also cannot be fired from a gun, but can only be exploded by a firing pin in the bore of gun in order to directly produce a sound like an actual gun.

In conclusion, this invention can be used to shoot a fixed target, or be used in a "jungle war game". It is light, convenient, cheap, and can produce an explosion-sound effect like an actual gun. Furthermore, if a toy gun is required to change its external appearance today, this invention can offer a toy gun not like an actual gun, but one which has a lifelike firing effect in order to compensate for the external appearance.

This invention not only can offer a surprising effect, but also the shape of the toy gun will not be limited to a conventional gun, so its shape may be that of a future new model. It has a lifelike explosion-sound effect, so it can attract the players who are interested in jungle war game.

While in the foregoing specification a detailed description of specific embodiments of the invention were set forth purpose of illustration, it will be understood that many of the details herein given may be varied considerably by those skilled in the art without departing from the spirit and scope of the invention.

I claim

1. A safety, explosion producing bullet for a toy gun comprising:
   a) a body having an outer surface and defining a cavity opening through the outer surface;
   b) an explosive material comprising a mixture of gunpowder, paste and sand located in the cavity; and
   c) a layer attached to the body so as to cover the cavity opening whereby the force generator by exploding the explosive material is sufficient to rupture the layer, but is insufficient to fracture the body.

2. The safety, explosion producing bullet of claim 1 wherein the body is generally spherical in configuration.

3. The safety, explosion-producing bullet of claim 1 wherein the layer covers less than the entire outer surface of the body.

* * * * *